US010544986B2

(12) United States Patent
Wehrman et al.

(10) Patent No.: US 10,544,986 B2
(45) Date of Patent: Jan. 28, 2020

(54) PARALLEL COMPRESSION IN LNG PLANTS USING A DOUBLE FLOW COMPRESSOR

(71) Applicant: Air Products and Chemicals, Inc., Allentown, PA (US)

(72) Inventors: Joseph Gerard Wehrman, Macungie, PA (US); Gowri Krishnamurthy, Sellersville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 279 days.

(21) Appl. No.: 15/472,701

(22) Filed: Mar. 29, 2017

(65) Prior Publication Data

US 2018/0283774 A1 Oct. 4, 2018

(51) Int. Cl.
*F25J 1/02* (2006.01)
*F25J 1/00* (2006.01)

(52) U.S. Cl.
CPC ..... *F25J 1/0227* (2013.01); *F25J 1/0022* (2013.01)

(58) Field of Classification Search
CPC ..... F25J 1/0227; F25J 1/0047; F25J 1/0022; F25J 1/0052; F25J 1/0055; F25J 1/0087; F25J 1/0207; F25J 1/0216; F25J 1/0274; F25J 1/0279; F25J 1/0292; F25J 2230/20; F25J 1/0294; F04D 17/12; F04D 19/02; F04D 25/16; F04D 27/0269; F04D 29/5826; F25B 1/04; F25B 1/10; F25B 2400/0751; F25B 2400/13; F25B 2400/23
See application file for complete search history.

(56) References Cited

U.S. PATENT DOCUMENTS

| | | | | |
|---|---|---|---|---|
| 9,284,964 | B2 * | 3/2016 | Sites | F04D 25/04 |
| 2009/0025422 | A1 * | 1/2009 | Sicinski | F25J 1/0022 62/613 |
| 2010/0122551 | A1 * | 5/2010 | Roberts | F25J 1/0022 62/613 |
| 2010/0147024 | A1 * | 6/2010 | Roberts | F25J 1/0022 62/612 |
| 2011/0259045 | A1 | 10/2011 | Byfield et al. | |
| 2013/0058800 | A1 | 3/2013 | Angus | |
| 2013/0061632 | A1 * | 3/2013 | Brostow | F25J 1/0022 62/611 |
| 2016/0131422 | A1 | 5/2016 | Kikkawa et al. | |
| 2019/0041124 | A1 * | 2/2019 | Berti | F01D 15/005 |

FOREIGN PATENT DOCUMENTS

| | | |
|---|---|---|
| AU | 2013204886 | 10/2014 |
| CA | 2458550 | 3/2003 |
| GB | 885506 | 12/1961 |
| WO | 15153146 | 10/2015 |

* cited by examiner

*Primary Examiner* — Melvin Jones
(74) *Attorney, Agent, or Firm* — Amy Carr-Trexler

(57) ABSTRACT

A system and method is provided for increasing the capacity and efficiency of natural gas liquefaction processes by debottlenecking the refrigerant compression system. A secondary compression circuit comprising at least one double flow compressor is provided in parallel fluid flow communication with at least a portion of a primary compression circuit.

20 Claims, 10 Drawing Sheets

PARALLEL COMPRESSION IN LNG PLANTS USING A DOUBLE FLOW COMPRESSOR

BACKGROUND

Liquefaction systems for cooling, liquefying, and optionally sub-cooling natural gas are well known in the art, such as the single mixed refrigerant (SMR) cycle, the propane pre-cooled mixed refrigerant (C3MR) cycle, the dual mixed refrigerant (DMR) cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Each refrigerant compression system includes a compression circuit for compressing and cooling the circulating refrigerant, and a driver assembly to provide the power needed to drive the compressors. The refrigerant compression system is a critical component of the liquefaction system because the refrigerant needs to be compressed to high pressure and cooled prior to expansion in order to produce a cold low pressure refrigerant stream that provides the heat duty necessary to cool, liquefy, and optionally sub-cool the natural gas.

A majority of the refrigerant compression in base-load LNG plants is performed by dynamic or kinetic compressors, and specifically centrifugal compressors, due to their inherent capabilities including high capacity, variable speed, high efficiency, low maintenance, small size, etc. Other types of dynamic compressors such as axial compressors and mixed flow compressors have also been used for similar reasons. Dynamic compressors function by increasing the momentum of the fluid being compressed. Positive displacement compressors may also be used, although they have much lower capacity than typical dynamic compressors, and function by reducing the volume of the fluid being compressed.

There are three main types of drivers that have been used for LNG service, namely gas turbines, steam turbines, and electric motors.

In some scenarios, the LNG production rate may be limited by the installed refrigerant compressor. One such scenario is when the compressor operating point is close to surge. —Surge is defined as an operating point at which the maximum head capability and minimum volumetric flow limit of the compressor are reached. An anti-surge line is an operating point at a safe operating approach to surge. An example of such a scenario for a C3MR cycle is at high ambient temperature where there is an increased load on the propane pre-cooling system causing the maximum head and thereby lowest allowable flow rate to be reached. Therefore, the refrigerant flow rate is limited, which then limits the refrigeration and LNG production rate.

Another scenario where the LNG production rate is limited by the installed refrigerant compressor is when the compressor is close to stonewall or choke. Stonewall or choke is defined as the operating point where the maximum stable volumetric flow and minimum head capability of the compressor are reached. An example of such a scenario is when the plant is fully loaded and is running at maximum LNG capacity. The compressor cannot take any more refrigerant flow through it and the plant is therefore limited by the compressor operation.

A further scenario where the LNG production may be limited by the installed refrigerant compressor is for large base-load facilities where the compressor operating points are limited by compressor design limits, such as the flow coefficient, the inlet Mach number, etc.

In some scenarios, the LNG production is limited by the available driver power. This can happen when the plant is operating at high LNG production rates. It can also happen for plants with gas turbine drivers at high ambient temperature due to reduced available gas turbine power.

Standard dynamic compressors utilized in the LNG industry comprise a single casing with one or more inlets and a single outlet. In case of multiple inlets, the casing also comprises chambers to mix the inlet streams with the discharge from previous compressor stages. For instance, a second compressor stage with two inlet streams would require a mixing chamber to mix the inlet stream with the discharge stream from the first compressor stage.

One approach to debottleneck the refrigerant compression system is to add a dynamic compressor, similar to one described above, such as a centrifugal compressor, with its driver at the discharge of the primary compressor. This helps build more head into the compression system for a scenario where the compressor is operating close to surge. Adding an additional dynamic compressor at the discharge of the primary compressor has limited benefits when the compressor is operating close to stonewall. Therefore, the addition of the additional dynamic compressor will not solve the problem of maximum flow constraint.

Another approach has been to add one or more dynamic compressors such as centrifugal compressors in parallel with the primary compressor. While this helps de-bottleneck the primary compressor to some extent, it may not be sufficient or efficient. This method debottlenecks the different compressor stages in the primary compressor by the same amount. However, certain stages may still be at their limits and may need further debottlenecking.

Overall, a single stage dynamic compressor in parallel with the primary compressor may lead to a suboptimal design. Therefore, what is needed is a compact and more efficient method of debottlenecking loaded compression systems in an LNG plant.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments provide, as described below and as defined by the claims which follow, comprise improvements to compression systems used as part of an LNG liquefaction processes. Some embodiments satisfy the need in the art by using a double flow compressor in parallel with the primary compression circuit in one or more of the refrigerant compression systems of an LNG liquefaction plant, thereby enabling the plant to operate under conditions that would otherwise limit plant capacity.

In addition, several specific aspects of the systems and methods are outlined below.

Aspect 1: A compression system operationally configured to compress a first stream of a first refrigerant having a first pressure to produce a first compressed refrigerant stream having a fully-compressed pressure, the compression system comprising:

at least one pre-cooling heat exchanger, each of the at least one pre-cooling heat exchangers being operationally configured to cool a hydrocarbon fluid by indirect heat exchange against the first refrigerant;

a primary compression circuit having a plurality of primary compressor stages and a plurality of a partially-compressed streams, each of the plurality of compressor stages having a suction side and a discharge side, each of the plurality of partially-compressed streams being in fluid flow communication with an outlet of one of the plurality of primary compressor stages and an inlet of another of the plurality of primary compressor stages, each of the plurality of partially-compressed streams having a pressure that is higher than the first pressure and lower than the fully-compressed pressure, the pressure of each of the plurality of partially-compressed streams being different than the pressure of every other of the plurality of partially-compressed streams, a final primary compressor stage of the plurality of primary compressor stages having an outlet that produces a first portion of the first compressed refrigerant steam;

a secondary compression circuit comprising a double flow compressor having a casing that defines an internal volume, a first inlet, a second inlet, and an outlet that produces a second portion of the first compressed refrigerant stream, the second portion of the first compressed refrigerant stream being in fluid flow communication with the first portion of the first compressed refrigerant stream, the casing further comprising a first compressor stage and a second compressor stage located in the internal volume, the first compressor stage having a first suction side, a first discharge side, at least one first impeller, and at least one first diffuser, the second compressor stage having a second suction side, a second discharge side, at least one second impeller, and at least one second diffuser, the first suction side being distal to the second suction side, and the first discharge side being proximal to the second discharge side;

a first side stream located downstream from and in fluid flow communication with a first pre-cooling heat exchanger of the at least one pre-cooling heat exchanger, the first side stream having a first side stream pressure and a first portion that is in fluid flow communication with a first partially-compressed first refrigerant stream of the plurality of partially-compressed streams to form a first mixed stream that is upstream from and in fluid flow communication with an inlet of a first primary compressor stage of the plurality of primary compressor stages, the first side stream having a second portion that is in fluid flow communication with the first inlet of the double-flow compressor; and a second side stream downstream from and in fluid flow communication with a second pre-cooling heat exchanger of the at least one pre-cooling heat exchanger, the second side stream having a second side stream pressure and a first portion that is in fluid flow communication with a second partially-compressed first refrigerant stream of the plurality of partially-compressed streams to form a second mixed stream that is upstream from and in fluid flow communication with an inlet of a second primary compressor stage of the plurality of primary compressor stages, the second side stream having a second portion that is in fluid flow communication with the second inlet of the double flow compressor;

wherein the first inlet is located on the first suction side of the first compressor stage, the second inlet is located on the second suction side of the second compressor stage, and the outlet is located proximal to the first discharge side and the second discharge side.

Aspect 2: The compression system of Aspect 1, wherein the at least one first impeller consists of a first number of impellers, each having a first impeller geometry, the at least one second impeller consists of a second number of impellers, each having a second impeller geometry, the at least one first diffuser each having a first diffuser geometry, and the second at least one second diffuser having a second diffuser geometry; and wherein the first compressor stage differs from the second compressor stage by at least one selected from the group of: (a) the first number of impellers is different from the second number of impellers, (b) the first impeller geometry is different from the second impeller geometry, and (c) the first diffuser geometry is different from the second diffuser geometry.

Aspect 3: The compression system of Aspect 2, wherein the first number of impellers is different from the second number of impellers.

Aspect 4: The compression system of Aspect 2, wherein the first number of impellers is greater than the second number of impellers.

Aspect 5: The compression system of any of Aspects 1-3, wherein the casing further comprises a mixing chamber that is proximal to the first and second discharge sides.

Aspect 6: The compression system of any of Aspects 1-4, wherein the first refrigerant is propane.

Aspect 7: The compression system of any of Aspects 1-6, wherein the compression system is further operationally configured to inter-cool the first refrigerant between at least two of the plurality of primary compressor stages of the primary compression circuit.

Aspect 8: The compression system of any of Aspects 1-7, further comprising a main heat exchanger operationally configured to further cool and liquefy the hydrocarbon fluid by indirect heat exchange between the hydrocarbon fluid and a second refrigerant after the hydrocarbon fluid has been cooled by the at least one pre-cooling heat exchanger.

Aspect 9: The compression system of Aspect 5, wherein the main heat exchanger is operationally configured to liquefy the hydrocarbon fluid and cool the second refrigerant as the hydrocarbon fluid and the second refrigerant flow through a coil wound tube side of the main heat exchanger by indirect heat exchange with the second refrigerant flowing through a shell side of the main heat exchanger.

Aspect 10: The compression system of any of Aspects 1-9, wherein the second refrigerant is a mixed refrigerant and the first refrigerant is a propane.

Aspect 11: The compression system of any of Aspects 1-10, wherein the driver assembly including a first driver for the primary compression circuit and a second driver for the secondary compression circuit, the first driver being independent of the second driver.

Aspect 12: The compression system of any of Aspects 1-11, further comprising a valve operationally configured to control a distribution of flow of the first refrigerant between primary compression circuit and the secondary compression circuit.

Aspect 13: The compression system of any of Aspects 1-12, wherein the first primary compressor stage has a first primary head-flow ratio and the first compressor stage of the double flow compressor has a first secondary head-flow ratio that is less than the first primary head-flow ratio.

Aspect 14: The compression system of any of Aspects 1-13, wherein the secondary head-flow ratio is 70-90% of the primary head-flow ratio.

Aspect 15: The compression system of any of Aspects 1-14, wherein the primary head-flow ratio is 50-95%.

Aspect 16: A compressor comprising:

a casing that defines an internal volume, a first inlet, a second inlet, and an outlet, the casing further comprising a first compressor stage and a second compressor stage located in the internal volume, the first compressor stage having a first suction side, a first discharge side, at least one first impeller, and at least one first diffuser, the second compressor stage having a second suction side, a second discharge side, at least one second impeller, and at least one second diffuser, the first suction side being distal to the second suction side, the first discharge side being proximal to the second discharge side; and wherein the first inlet is located on the first suction side of the first compressor stage, the second inlet is located on the second suction side of the second compressor stage, and the outlet is located proximal to the first pressure side and the second pressure side;

wherein the at least one first impeller consists of a first number of impellers, each having a first impeller geometry, the at least one second impeller consists of a second number of impellers, each having a second impeller geometry, the at least one first diffuser each having a first diffuser geometry, and the second at least one second diffuser having a second diffuser geometry;

wherein the first compressor stage differs from the second compressor stage by at least one selected from the group of: (a) the first number of impellers is different from the second number of impellers, (b) the first impeller geometry is different from the second impeller geometry, and (c) the first diffuser geometry is different from the second diffuser geometry.

Aspect 17: The compressor of Aspect 16, wherein the first number of impellers is different from the second number of impellers.

Aspect 18: The compressor of Aspect 16, wherein the first number of impellers is greater than the second number of impellers.

Aspect 19: The compressor of any of Aspects 16-18, further comprising a mixing chamber that is proximal to the first discharge side, the second discharge side, and the outlet.

Aspect 20: The compressor of any of Aspects 16-19, wherein each of the at least one first impeller and each of the at least one second impeller are affixed to a first shaft.

Aspect 21: A method comprising:

a. compressing a first low pressure stream of a refrigerant and at least one side stream of the refrigerant in a primary compression sequence comprising a plurality of compressor stages to form a first partially-compressed primary stream at a first intermediate pressure and a fully-compressed primary stream at a final pressure, the final pressure being greater than the first intermediate pressure;

b. combining a first side stream of the at least one side stream with the first partially-compressed refrigerant stream;

c. separating a first slip stream from one selected from the group of: the first low pressure stream and the first side stream, the first slip stream having a first slip stream pressure;

d. compressing the first slip stream in a first secondary compressor stage to form a first compressed secondary stream;

e. separating a second slip stream from one of the at least one side stream, the second slip stream having a second slip stream pressure that is greater than the first slip stream pressure;

f. compressing the second slip stream in a second secondary compressor stage to the final pressure to form a second compressed secondary stream;

g. combining the first compressed secondary stream and the second compressed secondary stream with the fully-compressed refrigerant stream; and h. cooling a hydrocarbon by indirect heat exchange with the refrigerant.

Aspect 22: The method of Aspect 21, wherein steps (a), (b), and (d) comprise:

a. compressing a first stream of a refrigerant and at least one side stream of the refrigerant in a primary compression sequence comprising a plurality of compressor stages to form a first partially-compressed refrigerant stream at a first intermediate pressure, a second partially compressed refrigerant stream at a second intermediate pressure, and a fully-compressed refrigerant stream at a final pressure, the final pressure being greater than the second intermediate pressure and the second intermediate pressure being greater than the first intermediate pressure;

c. separating a first slip stream from a first side stream of the at least one side stream, the first slip stream having a first slip stream pressure that is equal to the first intermediate pressure; and d. separating a second slip stream from a second side stream of the at least one side stream, the second slip stream having a second slip stream pressure that is equal to the second intermediate pressure.

Aspect 23: The method of any of Aspects 21-22, further comprising:

i. combining the first compressed secondary stream with the second slip stream before performing step (f).

Aspect 24: The method of any of Aspects 15-22, wherein step (g) comprises mixing the first compressed secondary stream and the second compressed secondary stream to form a mixed secondary stream, then combining the mixed secondary stream with the fully-compressed refrigerant stream.

Aspect 25: The method of any of Aspects 15-24, further comprising, performing steps (f) and (g) within a single compressor casing.

Aspect 26: The method of Aspect 25, further comprising, performing steps (f) and (g) within a single compressor casing of a double-flow compressor.

Aspect 27: The method of Aspect 26, wherein steps (f) and (g) further comprise:

f. compressing the first slip stream in a first secondary compressor stage having a first discharge side to the final pressure to form a first compressed side stream; and g. compressing the second slip stream in a second secondary compressor stage, having a second discharge side that is proximal to the first discharge side, to the final pressure to form a second compressed side stream.

Aspect 28: The method of Aspect 26, wherein steps (f) and (g) further comprise:

f. compressing the first slip stream a first secondary compressor stage, comprising at least one first impeller having a first impeller geometry, to the final pressure, to form a first compressed secondary stream; and g. compressing the second slip stream in a second secondary compressor stage, comprising at least one second impeller having a second impeller geometry that is different from the first impeller geometry, to the final pressure to form a second compressed secondary stream.

DETAILED DESCRIPTION

Figure 1:
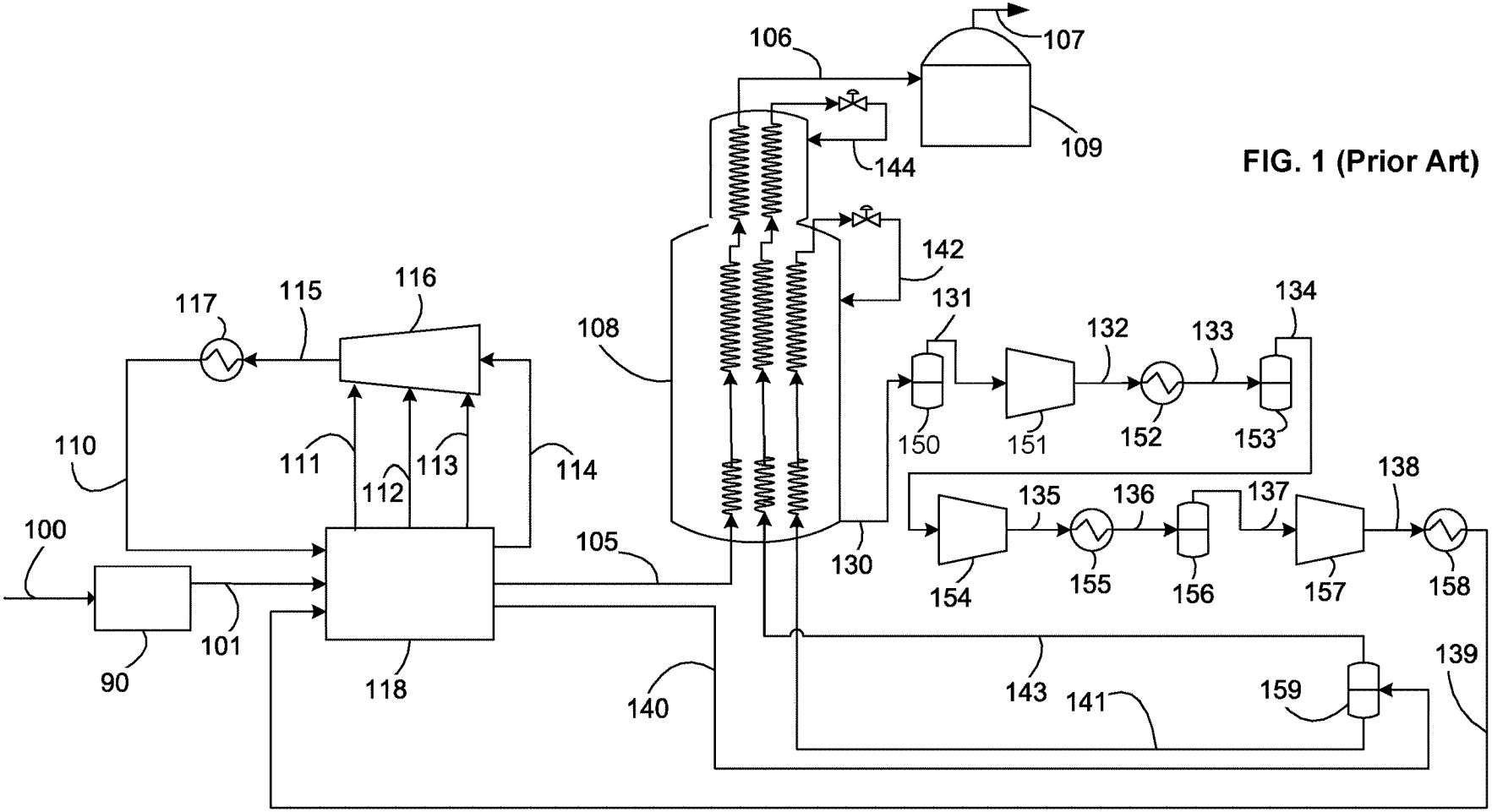
FIG. 1 (Prior Art)
FIG. 1 is a schematic flow diagram of a C3MR system in accordance with the prior art.

The ensuing detailed description provides preferred exemplary embodiments only, and is not intended to limit the scope, applicability, or configuration. Rather, the ensuing detailed description of the preferred exemplary embodiments will provide those skilled in the art with an enabling description for implementing the preferred exemplary embodiments. Various changes may be made in the function and arrangement of elements without departing from their spirit and scope.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the disclosed embodiments (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compressor stage and ending downstream from the last compressor or compressor sage. The term "compression sequence" is intended to refer to the steps performed by the components and conduits that comprise the associated compression circuit.

As used in the specification and claims, the terms "high-high", "high", "medium", and "low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

As used herein, the term "compressor" in intended to mean a device having at least one compressor stage contained within a casing and that increases the pressure of a fluid stream.

As used herein, the term "double flow compressor" is intended to mean a compressor having at least two compressor stages contained within a single casing and having at least two inlet streams and at least one outlet stream. In addition, the inlet streams are compressed separately and combined at the discharge to produce the outlet stream.

As used herein, the term "casing" is intended to mean a pressure-containing shell than defines an internal volume and which contains at least one compressor stage. When two or more pressure containing shells are connected by conduits, the arrangement is considered two or more casings.

As used herein, the term "compressor stage" is intended to mean a device that increases the pressure of a fluid and has a single inlet, a single outlet, and one or more impellers and their associated diffusers.

As used herein, the term "impeller" is intended to mean a rotating device that increases the pressure of the fluid entering it.

As used herein, the term "diffuser" is intended to mean a device located at the outlet of an impeller that converts at least a portion of the dynamic pressure of the fluid to static pressure. A diffuser may optionally include adjustable guide vanes, which can be moved to change the operating characteristics of the compressor stage with which the diffuser is associated.

Table 1 defines a list of acronyms employed throughout the specification and drawings as an aid to understanding the described embodiments.

TABLE 1

| | | | |
|---|---|---|---|
| SMR | Single Mixed Refrigerant | MCHE | Main Cryogenic Heat Exchanger |
| DMR | Dual Mixed Refrigerant | MR | Mixed Refrigerant |
| C3MR | Propane-precooled Mixed Refrigerant | MRL | Mixed Refrigerant Liquid |
| LNG | Liquid Natural Gas | MRV | Mixed Refrigerant Vapor |

The described embodiments provide an efficient process for the liquefaction of a hydrocarbon fluid and are particularly applicable to the liquefaction of natural gas. Referring to FIG. 1, a typical C3MR process of the prior art is shown. A feed stream 100, which is preferably natural gas, is cleaned and dried by known methods in a pre-treatment section 90 to remove water, acid gases such as $CO_2$ and $H_2S$, and other contaminants such as mercury, resulting in a pre-treated feed stream 101. The pre-treated feed stream 101, which is essentially water free, is pre-cooled in a pre-cooling system 118 to produce a pre-cooled natural gas stream 105 and further cooled, liquefied, and/or sub-cooled in an MCHE 108 (also referred to as a main heat exchanger) to produce LNG stream 106. The LNG stream 106 is typically let down in pressure by passing it through a valve or a turbine (not shown) and is then sent to LNG storage tank 109. Any flash vapor produced during the pressure letdown and/or boil-off in the tank is represented by stream 107, which may be used as fuel in the plant, recycled to feed, or vented.

Figure 2:
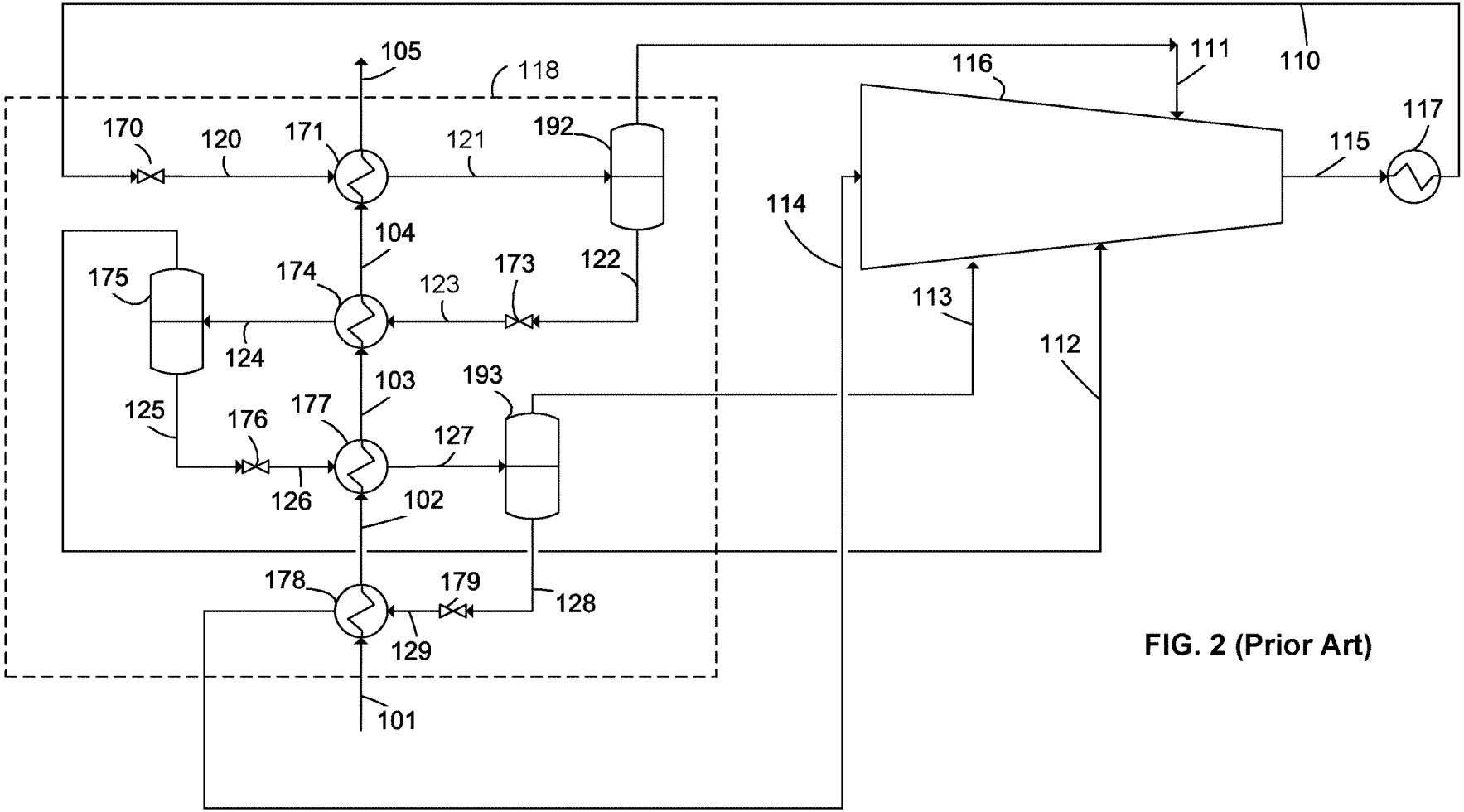
FIG. 2 (Prior Art)
FIG. 2 is a schematic flow diagram of a pre-cooling system of a C3MR system in accordance with the prior art.

The pre-treated feed stream 101 is pre-cooled to a temperature below 10 degrees Celsius, preferably below about 0 degrees Celsius, and more preferably about −30 degrees Celsius. The pre-cooled natural gas stream 105 is liquefied to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. MCHE 108 shown in FIG. 2 is a coil wound heat exchanger with three bundles. However, any number of bundles and any exchanger type may be utilized.

The term "essentially water free" means that any residual water in the pre-treated feed stream 101 is present at a sufficiently low concentration to prevent operational issues associated with water freeze-out in the downstream cooling and liquefaction process. In the embodiments described in herein, water concentration is preferably not more than 1.0 ppm and, more preferably between 0.1 ppm and 0.5 ppm.

The pre-cooling refrigerant used in the C3MR process is propane. As illustrated in FIG. 2, propane refrigerant 110 is warmed against the pre-treated feed stream 101 to produce a warm low pressure propane stream 114. The warm low pressure propane stream 114 is compressed in one or more propane compressor 116 that may comprise four compressor stages 116A, 116B, 116C, 116D. Three side streams 111, 112, and 113 at intermediate pressure levels enter the propane compressor 116 at the suction of the final 116D, third 116C, and second 116B stages of the propane compressor 116 respectively. The compressed propane stream 115 is condensed in condenser 117 to produce a cold high pressure stream that is then let down in pressure (let down valve not shown) to produce the propane refrigerant 110 that provides the cooling duty required to cool pre-treated feed stream 101 in pre-cooling system 118. The propane liquid evaporates as it warms up to produce warm low pressure propane stream 114. The condenser 117 typically exchanges heat against an ambient fluid such as air or water. Although the figure shows four stages of propane compression, any number of compressor stages may be employed. It should be understood that when multiple compressor stages are described or claimed, such multiple compressor stages could comprise a single multi-stage compressor, multiple compressors, or a combination thereof. The compressors could be in a single casing or multiple casings. The process of compressing the propane refrigerant is generally referred to herein as the propane compression sequence. The propane compression sequence is described in greater detail in FIG. 2.

In the MCHE 108, at least a portion of, and preferably all of, the refrigeration is provided by vaporizing at least a portion of refrigerant streams after pressure reduction across valves or turbines.

A low pressure gaseous MR stream 130 is withdrawn from the bottom of the shell side of the MCHE 108, sent through a low pressure suction drum 150 to separate out any liquids and the vapor stream 131 is compressed in a low pressure (LP) compressor 151 to produce medium pressure MR stream 132. The low pressure gaseous MR stream 130 is typically withdrawn at a temperature at or near propane pre-cooling temperature and preferably about −30 degree Celsius and at a pressure of less than 10 bar (145 psia). The medium pressure MR stream 132 is cooled in a low pressure aftercooler 152 to produce a cooled medium pressure MR stream 133 from which any liquids are drained in medium pressure suction drum 153 to produce medium pressure vapor stream 134 that is further compressed in medium pressure (MP) compressor 154. The resulting high pressure MR stream 135 is cooled in a medium pressure aftercooler 155 to produce a cooled high pressure MR stream 136. The cooled high pressure MR stream 136 is sent to a high pressure suction drum 156 where any liquids are drained. The resulting high pressure vapor stream 137 is further compressed in a high pressure (HP) compressor 157 to produce high-high pressure MR stream 138 that is cooled in high pressure aftercooler 158 to produce a cooled high-high pressure MR stream 139. Cooled high-high pressure MR stream 139 is then cooled against evaporating propane in pre-cooling system 118 to produce a two-phase MR stream 140. Two-phase MR stream 140 is then sent to a vapor-liquid separator 159 from which an MRL stream 141 and a MRV stream 143 are obtained, which are sent back to MCHE 108 to be further cooled. Liquid streams leaving phase separators are referred to in the industry as MRL and vapor streams leaving phase separators are referred to in the industry as MRV, even after they are subsequently liquefied. The process of compressing and cooling the MR after it is withdrawn from the bottom of the MCHE 108, then returned to the tube side of the MCHE 108 as multiple streams, is generally referred to herein as the MR compression sequence.

Both the MRL stream 141 and MRV stream 143 are cooled, in two separate circuits of the MCHE 108. The MRL stream 141 is cooled and partially liquefied in the first two bundles of the MCHE 108, resulting in a cold stream that is let down in pressure to produce a cold two-phase stream 142 that is sent back to the shell-side of MCHE 108 to provide refrigeration required in the first two bundles of the MCHE. The MRV stream 143 is cooled in the first, second, and third bundles of MCHE 108, reduced in pressure across the cold high pressure letdown valve, and introduced to the MCHE 108 as stream 144 to provide refrigeration in the sub-cooling, liquefaction, and cooling steps. MCHE 108 can be any exchanger suitable for natural gas liquefaction such as a coil wound heat exchanger, plate and fin heat exchanger or a shell and tube heat exchanger. Coil wound heat exchangers are the state of art exchangers for natural gas liquefaction and include at least one tube bundle comprising a plurality of spiral wound tubes for flowing process and warm refrigerant streams and a shell space for flowing a cold refrigerant stream.

FIG. 2 illustrates an exemplary arrangement of the pre-cooling system 118 and the pre-cooling compression sequence depicted in FIG. 1. The pre-treated feed stream 101, as described in FIG. 1, is cooled by indirect heat exchange in evaporators 178, 177, 174, and 171 to produce cooled propane streams 102, 103, 104, and 105 respectively. The warm low pressure propane stream 114 is compressed in propane compressor 116 to produce compressed propane stream 115. The propane compressor 116 is shown as a four stage compressor with side streams 113, 112, and 111 entering it. The compressed propane stream 115 is typically fully condensed by indirect heat exchange in condenser 117 to produce the propane refrigerant 110 that may be let down in pressure in propane expansion valve 170 to produce stream 120, which is partially vaporized in the high-high pressure evaporator 171 to produce a two-phase stream 121, which may then be separated in vapor-liquid separator 192 into a vapor stream and a liquid refrigerant stream 122. The vapor stream is referred to as the high pressure side stream 111 and introduced at the suction of the fourth compressor stage 116D of propane compressor 116. The liquid refrigerant stream 122 is let down in pressure in letdown valve 173 to produce stream 123, which is partially vaporized in high pressure evaporator 174 to produce two-phase stream 124, which may then be separated in vapor-liquid separator 175. The vapor portion is referred to as a medium pressure side stream 112 and is introduced at the suction of the third compressor stage 116C of the propane compressor 116. The liquid refrigerant stream 125 is let down in pressure in letdown valve 176 to produce stream 126, which is partially vaporized in medium pressure evaporator 177 to produce a two-phase stream 127, which may be phase separated in vapor-liquid separator 193. The vapor portion is referred to as a low pressure side stream 113 and is introduced at the suction of the second compressor stage of propane compressor 116. The liquid refrigerant stream 128 is let down in pressure in letdown valve 179 to produce stream 129, which is fully evaporated in low pressure evaporator 178 to produce warm low pressure propane stream 114 that is sent to the suction of the first compressor stage 116A of the propane compressor 116.

In this manner, refrigeration may be supplied at four temperature levels corresponding to four evaporator pressure levels. It also possible to have more or less than four evaporators and temperature/pressure levels. Any type of heat exchangers may be used for evaporators 171, 174, 177, and 178 such as kettles, cores, plate and fin, shell and tube, coil wound, core in kettle, etc. In case of kettles, the heat exchanger and vapor-liquid separators may be combined into a common unit.

Propane refrigerant 110 is typically divided into two streams, to be sent to two parallel systems, one to pre-cool the pre-treated feed stream 101 to produce the pre-cooled natural gas stream 105, the other to cool the cooled high-high pressure MR stream 139 to produce two-phase MR stream 140. For simplicity, only the feed pre-cooling circuit is shown in FIG. 2.

Figure 3:
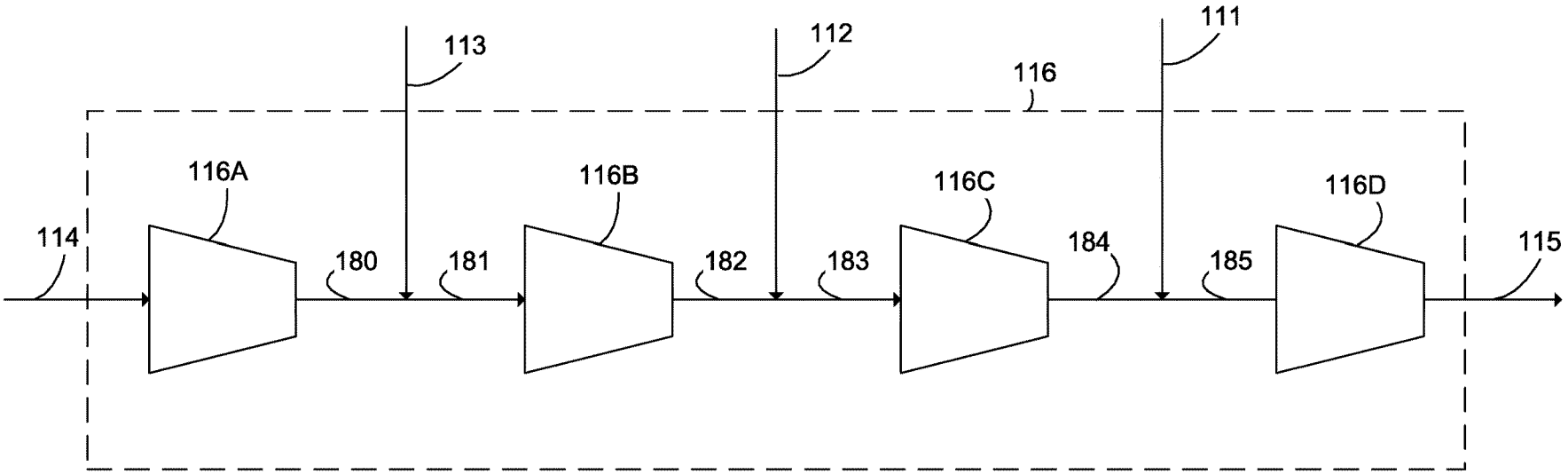
FIG. 3 (Prior Art)
FIG. 3 is a schematic flow diagram of a propane compression system of a C3MR system in accordance with the prior art.

FIG. 3 shows the propane compression system of a C3MR system. Propane compressor 116 may be a single compressor comprising four compressor stages or four separate compressors. It could also involve more or less than four compressor stages/compressors. Warm low pressure propane stream 114 at a pressure of about 1-5 bara enters the first compressor stage 116A to produce a medium pressure propane stream 180 at a pressure of about 1.5-10 bara. Medium pressure propane stream 180 then mixes with the low pressure side stream 113 to produce medium pressure mixed stream 181, which is fed to the second compressor stage 116B to produce a high pressure propane stream 182 at a pressure of about 2-15 bara. High pressure propane stream 182 then combines with the medium pressure side stream 112 to produce high pressure mixed stream 183, which is sent to the third compressor stage 116C to produce a high-high pressure propane stream 184 at a pressure of about 2.5-20 bara. High-high pressure propane stream 184 then combines with high pressure side stream 111 to produce high-high pressure mixed stream 185, which is sent to the fourth compressor stage 116D to produce compressed propane stream 115 at a pressure of about 2.5 to 30 bara. Compressed propane stream 115 is then condensed in condenser 117 of FIG. 2.

The pre-cooling and liquefaction compressors shown in FIGS. 1-3 are typically dynamic or kinetic compressors and specifically centrifugal compressors given their high capacity, variable speed, high efficiency, low maintenance, small size, etc. Other types of dynamic compressors such as axial and mixed flow compressors have also been used for similar reasons.

There are two primary compression circuits in the embodiment shown in FIGS. 1 through 3. The first primary compression circuit is part of the C3MR process, begins at the warm low pressure propane stream 114, ends at the compressed propane stream 115, and includes the four compressor stages 116A, 116B, 116C, 116D. The second primary compression circuit is part of the MR compression system, begins at the vapor stream 131, ends at the high-high pressure MR stream 138, and includes the LP compressor 151, the low pressure aftercooler 152, the medium pressure suction drum 153, the MP compressor 154, the medium pressure aftercooler 155, the high pressure suction drum 156, and the HP compressor 157.

Figure 4:
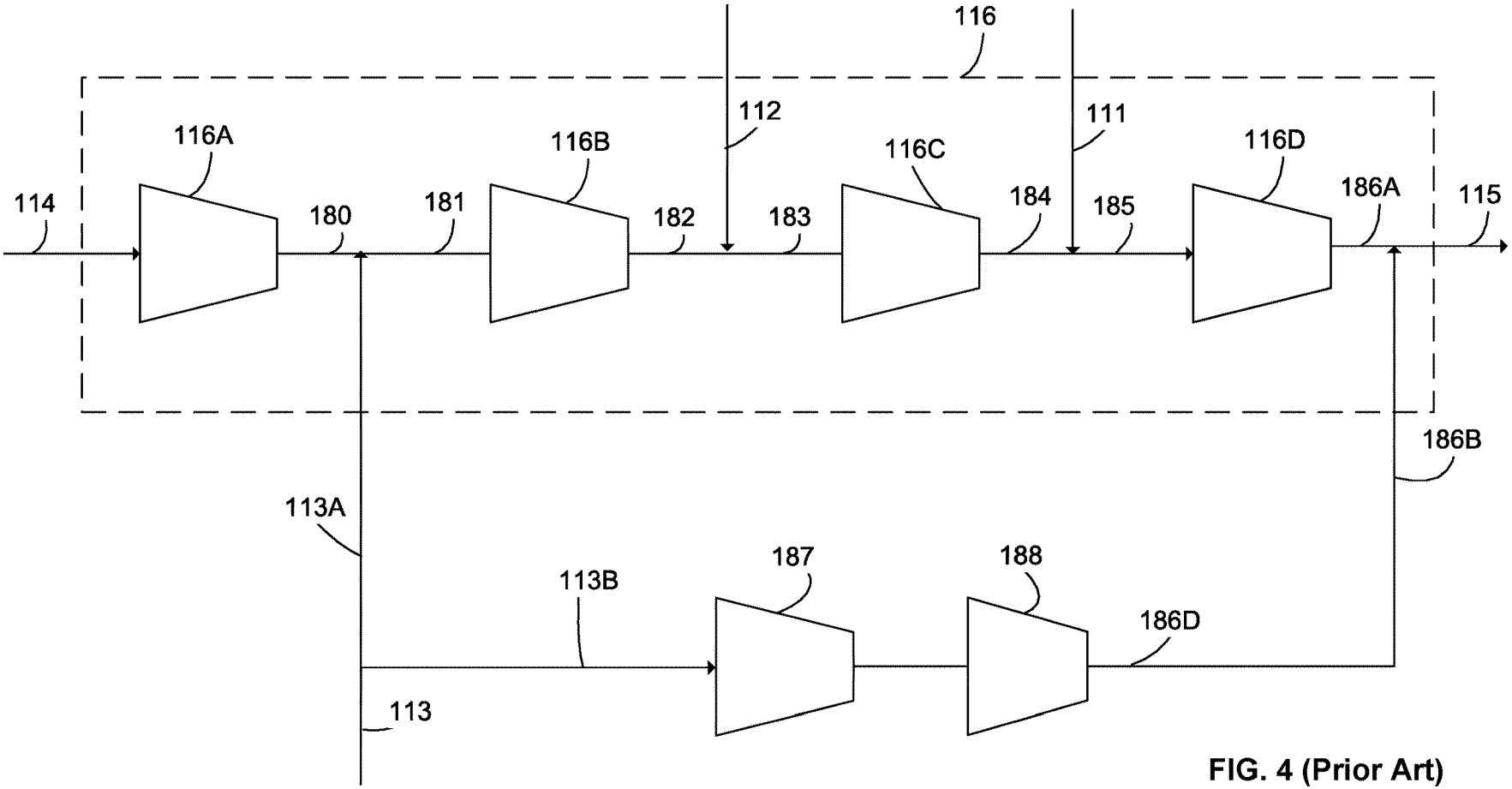
FIG. 4 (Prior Art)
FIG. 4 is a schematic flow diagram of a propane compression system of a C3MR system in accordance with the prior art.

FIG. 4 shows a prior art arrangement wherein the second, third, and fourth compressor stages 116B, 116C, and 116D are limiting the overall performance of the facility and a parallel compression train comprising a first secondary compressor stage 187 and second secondary compressor stage 188 is added in parallel to the said stages. In this embodiment, the low pressure side stream 113 is split into a primary low pressure side stream 113A and a secondary low pressure side stream 113B (also referred to as a "slip stream"). The primary low pressure side stream 113A is mixed with the medium pressure propane stream 180 to produce the medium pressure mixed stream 181, which is fed to the second compressor stage 116B to produce a high pressure propane stream 182. The secondary low pressure side stream 113B is compressed in the first secondary compressor stage 187 and the second secondary compressor stage 188 to produce a secondary outlet stream 186B. A drawback of this arrangement is that it debottlenecks each of the three stages of the primary compressor 116 by the same amount. However, the stages may be limited by different amounts, and it would not be efficient to have a single device with one flowrate across all the stages.

Figure 5:
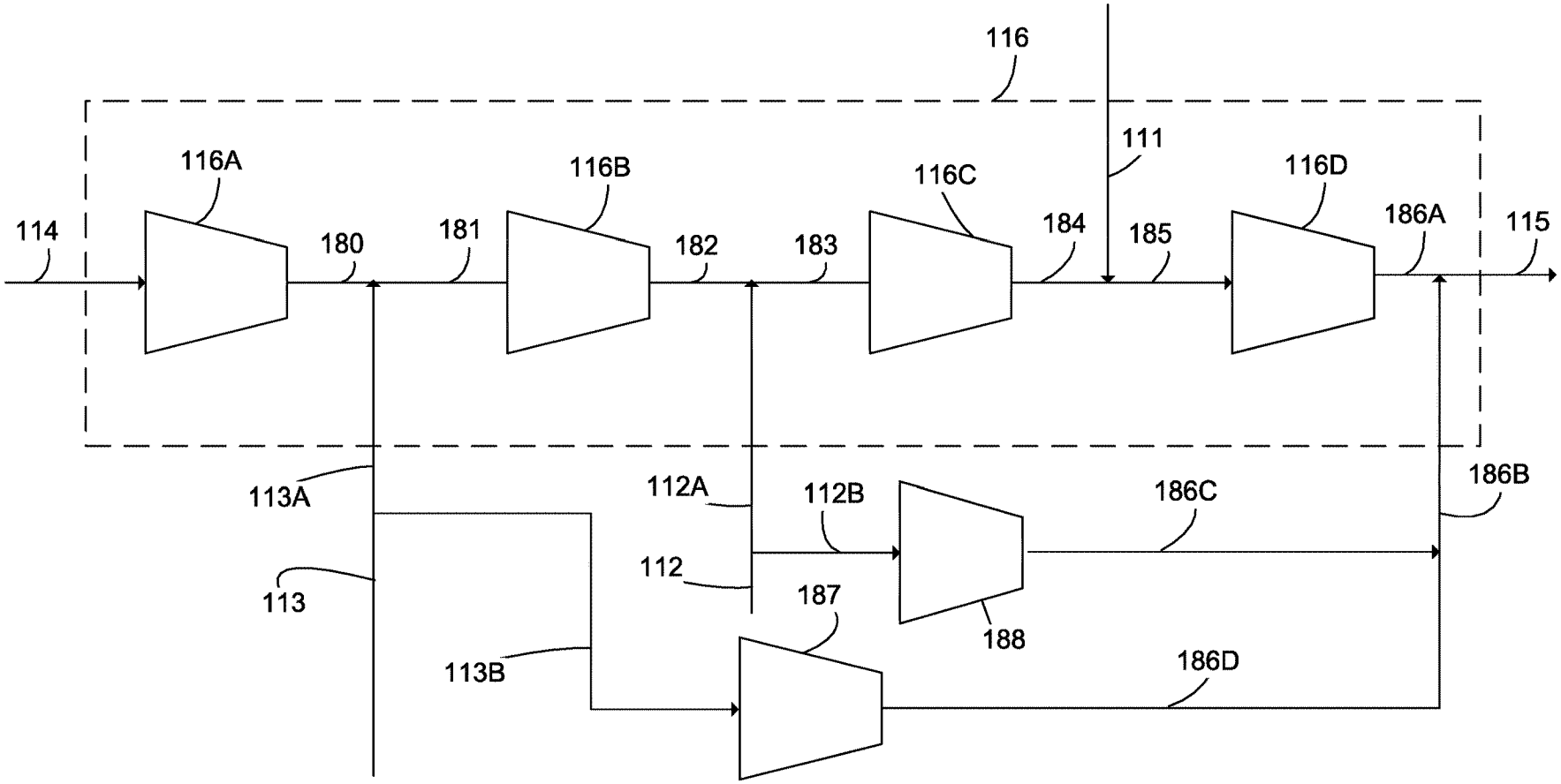
FIG. 5 is a schematic flow diagram of a propane compression system of a C3MR system in accordance with a first exemplary embodiment.

FIG. 5 shows an exemplary embodiment wherein a secondary compression circuit is installed in parallel with the second, third, and fourth compressor stages 116B, 116C, 116D of the propane compressor 116. In this embodiment, the low pressure side stream 113 is split into a primary low pressure side stream 113A and a secondary low pressure side stream 113B. The primary low pressure side stream 113A is mixed with the medium pressure propane stream 180 to produce the medium pressure mixed stream 181, which is fed to the second compressor stage 116B to produce a high pressure propane stream 182 at a pressure of about 2-15 bara. A medium pressure side stream 112 is split into a primary medium pressure side stream 112A and a secondary medium pressure side stream 112B. The high pressure propane stream 182 combines with the primary medium pressure side stream 112A to produce a high pressure mixed stream 183, which is sent to the third compressor stage 116C to produce a high-high pressure propane stream 184 at a pressure of about 2.5-20 bara. The high-high pressure propane stream 184 then combines with high pressure side stream 111 to produce high-high pressure mixed stream 185, which is sent to the fourth compressor stage 116D to produce a primary outlet stream 186A.

The secondary low pressure side stream 113B is sent to a first secondary compressor stage 187 and the secondary medium pressure side stream 112B are sent to a second secondary compressor stage 188 to produce a first secondary compressed stream 186D and a second secondary compressed stream 186C, which are mixed to produce a secondary outlet stream 186B. The secondary outlet stream 186B is mixed with the primary outlet stream 186A to produce a compressed propane stream 115 at a pressure of about 2.5 to 30 bara. The compressed propane stream 115 is then cooled and condensed in condenser 117 of FIG. 2. In an alternative embodiment, any of the side streams may be split between the primary and secondary compression circuits. In a further embodiment, the primary and secondary compression circuits may have separate condenser heat exchangers. In yet another embodiment, the secondary low pressure side stream 113B and the secondary medium pressure side stream 112B may be obtained from any other location in the primary compression circuit, such as from the medium pressure mixed stream 181 and the high pressure mixed stream 183 respectively. Additional secondary compressors may also be utilized.

A benefit of using the embodiment described in FIG. 5 is that it allows de-bottlenecking of multiple compressor stages of the primary compressor by different amounts. For instance, the third and fourth compressor stages 116C and 116D are bypassed by more flow than the second compressor stage 116B. Further, the flowrates of the secondary low pressure side stream 113B and the secondary medium pressure side stream 112B may be varied as needed.

Figure 6:
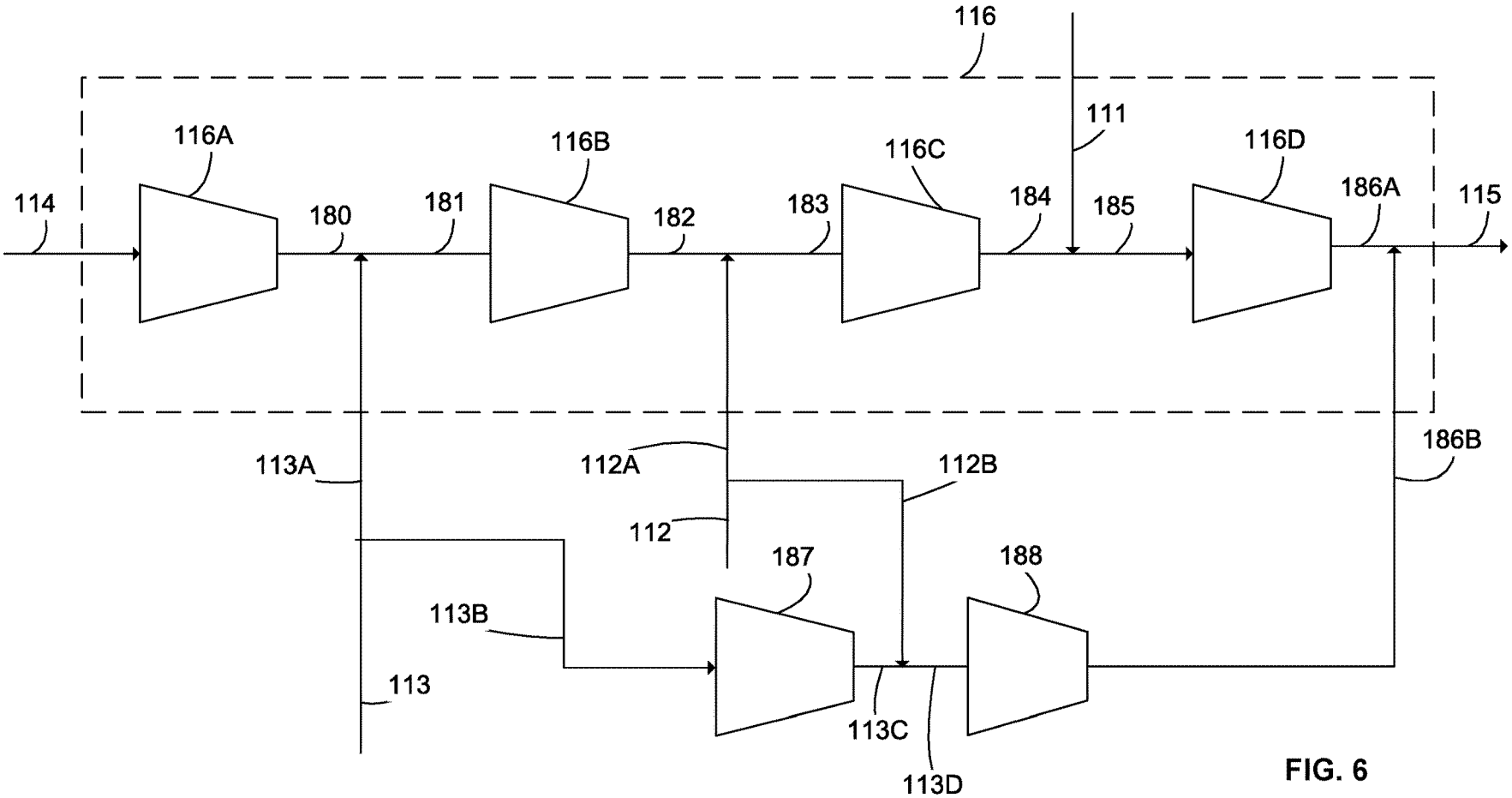
FIG. 6 is a schematic flow diagram of a propane compression system of a C3MR system in accordance with a second exemplary embodiment.

FIG. 6 shows another embodiment wherein the second, third, and fourth compressor stages 116B, 116C, and 116D of the primary compressor are de-bottlenecked. In this embodiment, the first secondary compressor stage 187 and the second secondary compressor stage 188 are arranged in series and the secondary medium pressure side stream 112B is introduced a side stream.

The low pressure side stream 113 is split into a primary low pressure side stream 113A and a secondary low pressure side stream 113B. The primary low pressure side stream 113A is mixed with the medium pressure propane stream 180 to produce the medium pressure mixed stream 181, which is fed to the second compressor stage 116B to produce a high pressure propane stream 182 at a pressure of about 2-15 bara. A medium pressure side stream 112 is split into a primary medium pressure side stream 112A and a secondary medium pressure side stream 112B. The high pressure propane stream 182 combines with the primary medium pressure side stream 112A to produce a high pressure mixed stream 183, which is sent to the third compressor stage 116C to produce a high-high pressure propane stream 184 at a pressure of about 2.5-20 bara. The high-high pressure propane stream 184 then combines with high pressure side stream 111 to produce high-high pressure mixed stream 185, which is sent to the fourth compressor stage 116D to produce a primary outlet stream 186A.

The secondary low pressure side stream 113B is sent to a first secondary compressor stage 187 to produce a first secondary intermediate stream 113C, which is mixed with the secondary medium pressure side stream 112B to produce a second secondary intermediate stream 113D. The second secondary intermediate stream 113D is compressed in a second secondary compressor to produce a secondary outlet stream 186B. The secondary outlet stream 186B is mixed with the primary outlet stream 186A to produce a compressed propane stream 115 at a pressure of about 2.5 to 30 bara. The compressed propane stream 115 is then cooled and condensed in condenser 117 of FIG. 2.

A benefit of this embodiment is that, similar to FIG. 5, it allows for differential de-bottlenecking of the primary compressor 116. The secondary low pressure side stream 113B and the secondary medium pressure side stream 112B may be of different flow rates and are at different pressures and temperatures.

Figure 7:
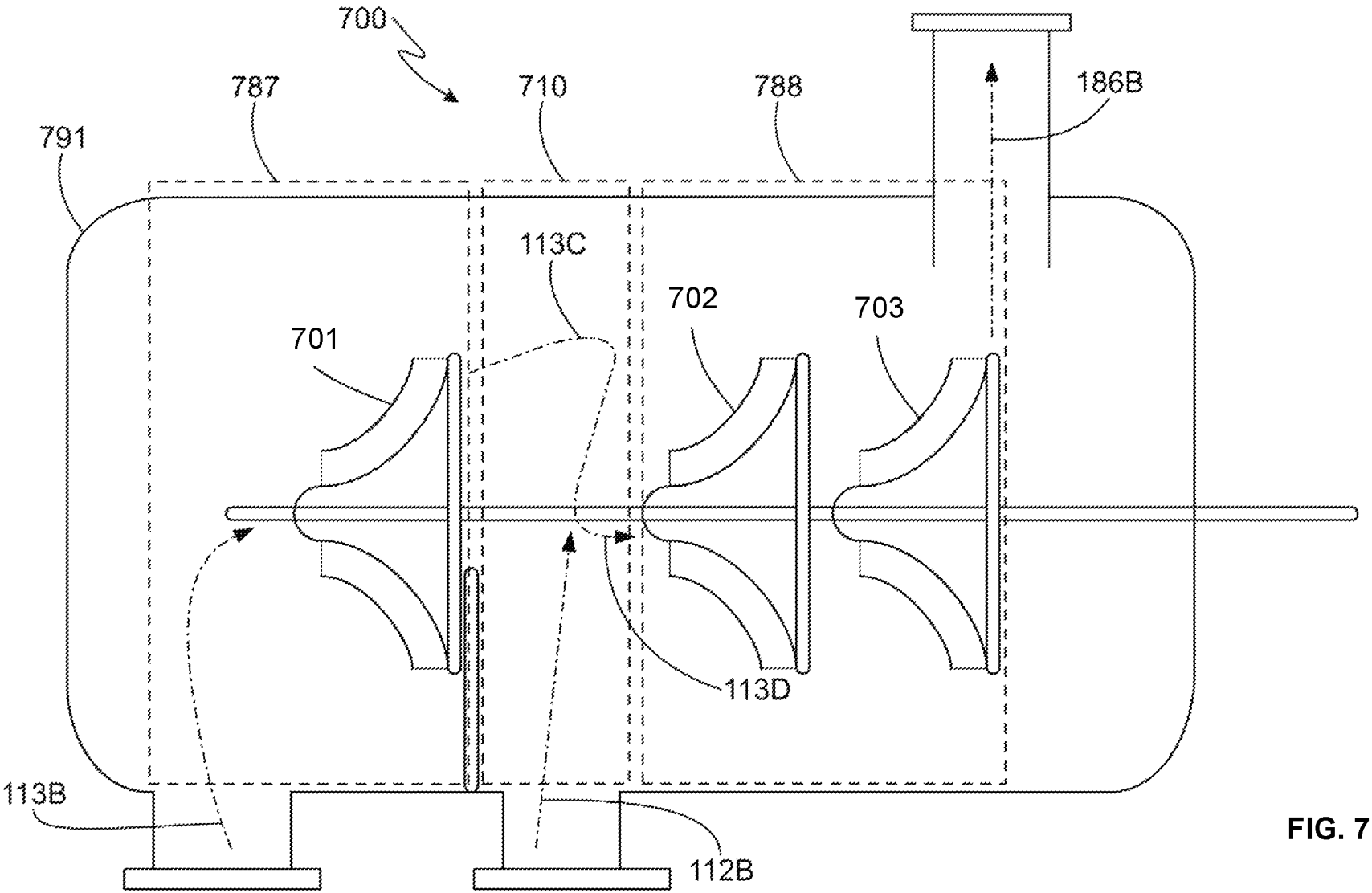
FIG. 7 is a schematic of a secondary compressor, as applied to the second exemplary embodiment.

An additional advantage of this embodiment is that the first secondary compressor stage 187 and the second secondary compressor stage 188 may be housed in a single compressor casing, which reduces equipment cost and the footprint of the facility. FIG. 7 shows a compressor 700 in which the first secondary compressor stage 187 and the second secondary compressor stage 188 of FIG. 6 are provided as a first secondary compressor stage 787 and a second secondary compressor stage 788, contained within a single casing 791. The streams flowing in and out of the first secondary compressor stage 787 and the second secondary compressor stage 788 are the same as shown in FIG. 6. The locations of secondary low pressure side stream 113B, the secondary medium pressure side stream 112B, the first secondary intermediate stream 113C, the second secondary intermediate stream 113D, and the secondary outlet stream 186B are shown in FIG. 7.

In the embodiment shown in FIG. 7, the first secondary compressor stage 787 contains a first impeller 701 and the second secondary compressor stage 788 contains two impellers: a second impeller 702 and a third impeller 703. Any number of impellers may be used for each compressor stage. In a preferred embodiment, the first secondary compressor stage 787 has more impellers than the second secondary compressor stage 788

An internal mixing chamber 710 is typically provided at the suction side 787A of the second secondary compressor stage 788 to allow for efficient mixing of the first secondary intermediate stream 113C with the secondary medium pressure side stream 112B to produce the secondary intermediate stream 113D.

Figure 8:
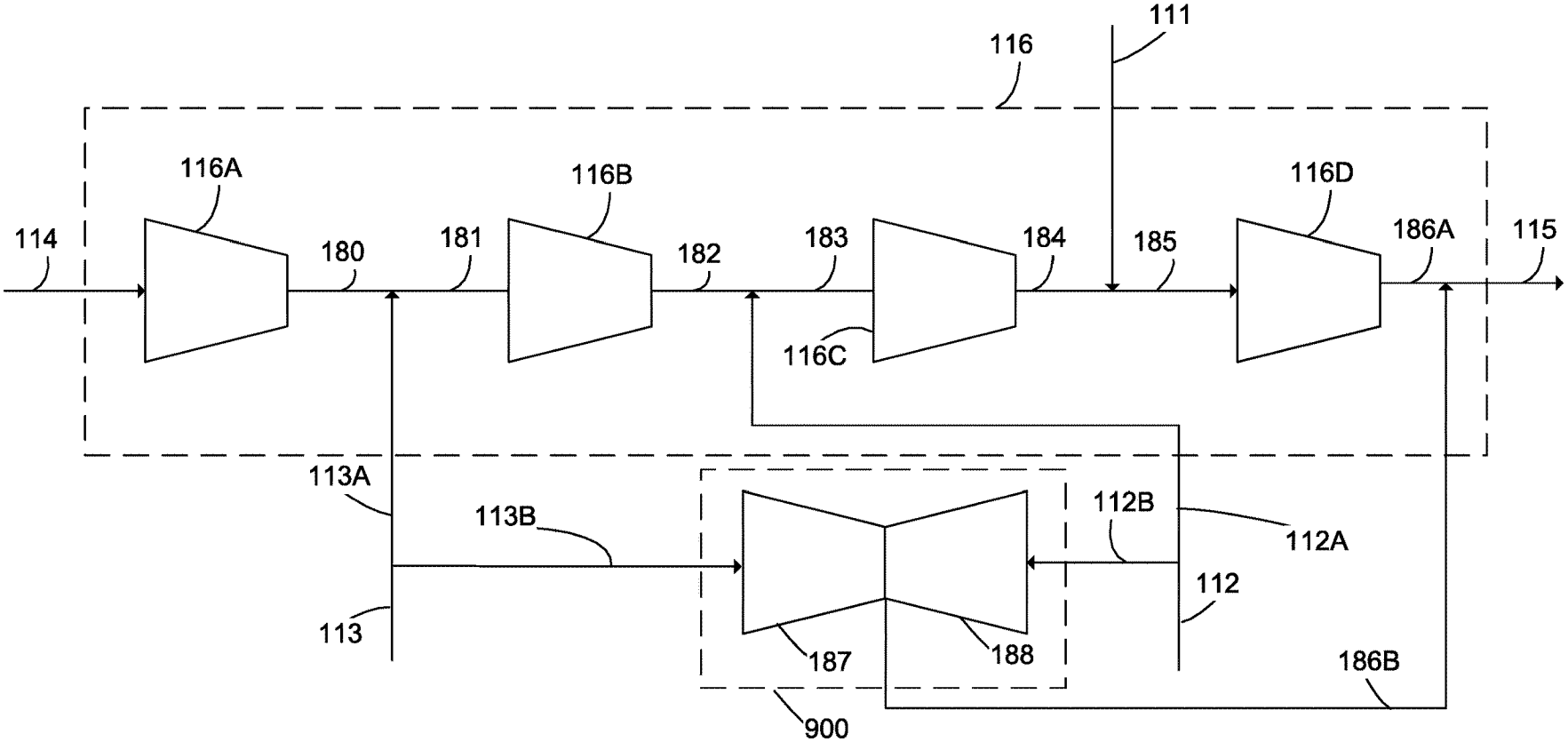
FIG. 8 is a schematic flow diagram of a mixed refrigerant compression system of a C3MR system in accordance with a third exemplary embodiment.

FIG. 8 shows a preferred embodiment wherein a secondary compression circuit is installed in parallel with the second, third, and fourth compressor stages 116B, 116C, 116D of the propane compressor 116. In this embodiment, the low pressure side stream 113 is split into a primary low pressure side stream 113A and a secondary low pressure side stream (slip stream) 113B. The primary low pressure side stream 113A is mixed with the medium pressure propane stream 180 to produce the medium pressure mixed stream 181, which is fed to the second compressor stage 116B to produce a high pressure propane stream 182 at a pressure of about 2-15 bara. A medium pressure side stream 112 is split into a primary medium pressure side stream 112A and a secondary medium pressure side stream 112B. The high pressure propane stream 182 combines with the primary medium pressure side stream 112A to produce a high pressure mixed stream 183, which is sent to the third compressor stage 116C to produce a high-high pressure propane stream 184 at a pressure of about 2.5-20 bara. The high-high pressure propane stream 184 then combines with high pressure side stream 111 to produce high-high pressure mixed stream 185, which is sent to the fourth compressor stage 116D to produce a primary outlet stream 186A.

The secondary low pressure side stream 113B and the secondary medium pressure side stream 112B are sent to a double flow compressor 190, which is comprised of two compression sections, the first secondary compressor stage 187 and the second secondary compressor stage 188. The secondary low pressure side stream 113B is compressed in the first secondary compressor stage 187 to produce a first secondary intermediate stream 113C. The secondary medium pressure side stream 112B is compressed in the second secondary compressor stage 188 to produce a second secondary intermediate stream 112C. The first and second secondary intermediate streams 112C, 113C (see FIG. 9, not shown in FIG. 8) are mixed within the double flow compressor 190 to produce a secondary outlet stream 186B. Typically, the first secondary intermediate stream 113C and the second secondary intermediate stream 112C are at the same pressure. In this embodiment, the secondary outlet stream 186B is mixed with the primary outlet stream 186A to produce a compressed propane stream 115 at a pressure of about 2.5 to 30 bara. The compressed propane stream 115 is then cooled and condensed in condenser 117 of FIG. 2.

In an alternative embodiment, different side streams than those shown in FIGS. 5, 6 and 8 could be split between the primary and secondary compression circuits. For example, a slip stream could be separated from stream 114 and directed to compressor stage 187 and a slip stream from any of the side streams 113, 112, 111 could be directed to compressor stage 188. In other embodiments, the primary and secondary compression circuits may have separate condenser heat exchangers. In other embodiments, the secondary low pressure side stream 113B and the secondary medium pressure side stream 112B may be obtained from another location in the primary compression circuit, such as from the medium pressure mixed stream 181 and the high pressure mixed stream 183 respectively. In alternative embodiments, multiple double flow compressors compressing multiple streams in the process may be utilized.

Figure 9:
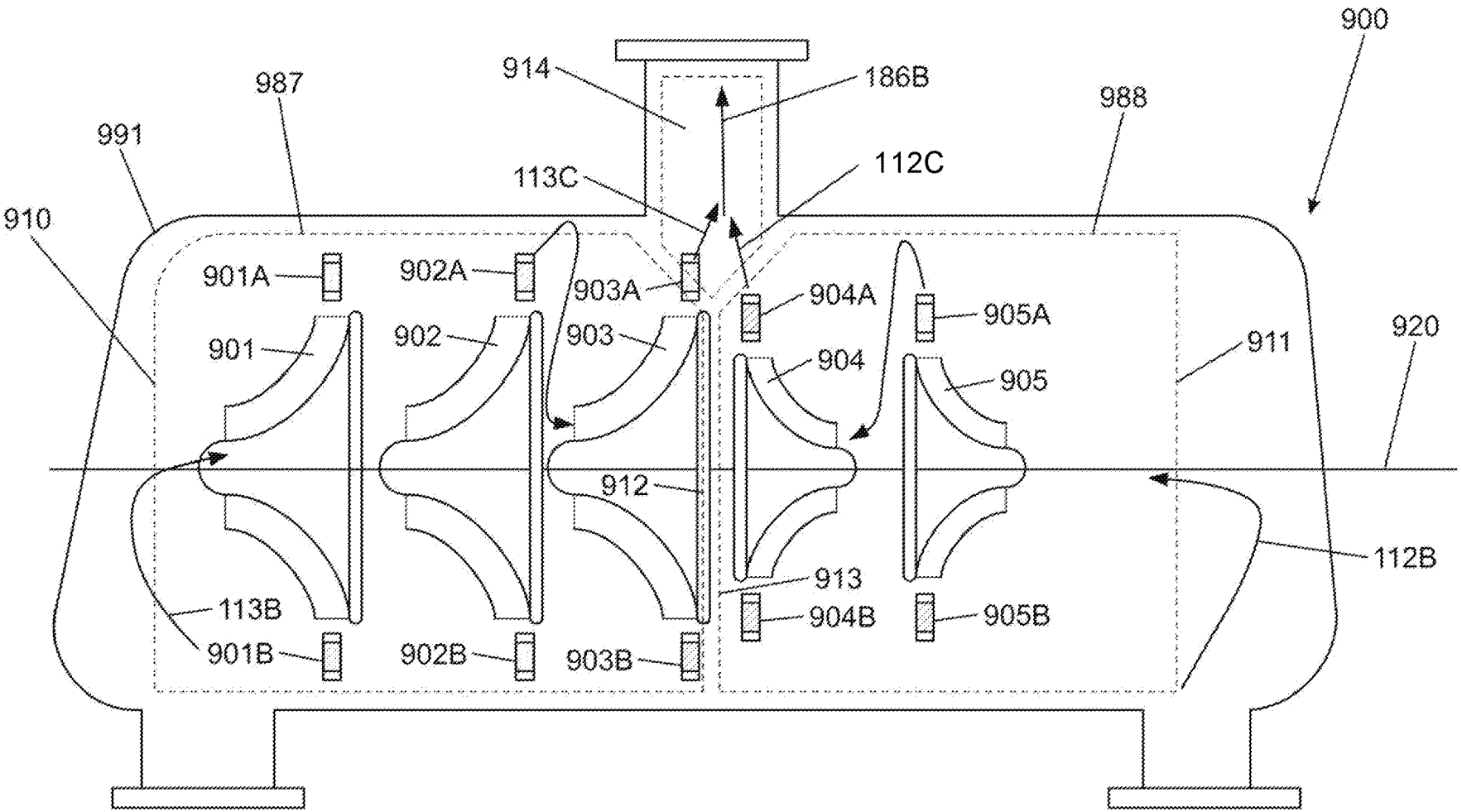
FIG. 9 is a schematic of a double flow compressor, as applied to the third exemplary embodiment.

FIG. 9 shows a schematic of the double flow compressor 900 and shows the first secondary compressor stage 987, the second secondary compressor stage 988, the secondary low pressure side stream 113B, the secondary medium pressure side stream 112B, the first secondary intermediate stream 113C, the second secondary intermediate stream 112C, and the secondary outlet stream 186B. Each secondary compressor stage 987, 988 comprises one or more impeller and both stages 987, 988 are contained within a single casing 991. In this embodiment, the first secondary compressor stage 987 contains three impellers 901, 902, 903 and their associated upper and lower diffusers 901A and 901B, 902A and 902B, and 903*a* and 903B, respectively. The second secondary compressor stage 988 contains two impellers 904, 905 and their associated their associated upper and lower diffusers 904A and 904B and 905A and 905B, respectively. All of the impellers of both secondary compressor stages 987, 988 are affixed to a single shaft 920 which is, in turn, driven by a single power source (not shown). In other embodiments, any number of impellers and their associated diffusers may be used for each compressor stage.

As noted above, a "double flow compressor" is a compressor having at least two stages contained within a single casing and having at least two inlet streams and at least one outlet stream. In addition, the two inlet streams are compressed separately and combined at the discharge to produce the outlet stream, as shown the double flow compressor 900 of FIG. 9. This results in the respective suction sides of the secondary compressor stages 987, 988 being distal to one another and the pressure sides being proximal. Double flow compressors can include any known type of compressor, such as dynamic or positive displacement.

Double flow compressors of the prior art are symmetrical in nature and the two inlet streams are identical in flow, pressure, and temperature. As a result, the geometry and number of impellers in both compressor stages is aerodynamically identical. The geometry of the compressor stage comprises impeller geometry and diffuser geometry. Impeller geometry and diffuser geometry include, but are not limited to, the number of blades, length of blades, and blade angle. In the embodiments shown in FIGS. 8-9, however, the two inlet streams 112B, 113B may be provided at different pressures and/or flow rates that must be combined into a single secondary outlet stream 186B (having a single pressure and flow rate). It is not practical to use a double flow compressor of the prior art under such operating conditions.

As is shown schematically in FIG. 9, the double flow compressor 900 is asymmetrical, meaning that (a) the number of impellors and/or (b) the geometry of the impellers is different in the first secondary compressor stage 987 than in the second secondary compressor stage 988.

A benefit of using the embodiment described in FIGS. 8-9 is that it allows for compression of two streams that are provided at different conditions, such as flowrates, temperatures, and pressures, within a single compressor body to produce two intermediate product (outlet) streams (also referred to as "pressure" sides). Further, it enables mixing of the two intermediate product streams at the discharge of the double flow compressor to produce a single product stream, which provides an improvement over mixing inlet streams at a compressor suction (such as is shown in FIG. 6-7). As explained above, this is enabled by the arrangement of the compressor stages 187, 188 with their respective suction sides 910, 911 being distal to one another and their respective discharge (also referred to as "pressure") sides 912, 913 being proximal to one another.

Mixing inlet streams in FIGS. 6-7 requires an internal mixing chamber 710 and involves matching pressures of the two inlet streams 112B, 113C. The two streams at the outlet of the double flow compressor 900 are the first secondary intermediate stream 113C and the second intermediate secondary stream 112C are they are both at the same pressure. Therefore, pressure matching is not an issue. The embodiment shown in FIGS. 8-9 also overcomes any process mixing inefficiencies and operational issues due to mixing streams at different temperatures. The embodiment described in FIGS. 8-9 eliminates the need for an internal mixing chamber 710 on the suction side of the second secondary compressor stage 788 and eliminates mixing inefficiencies.

Figure 10:
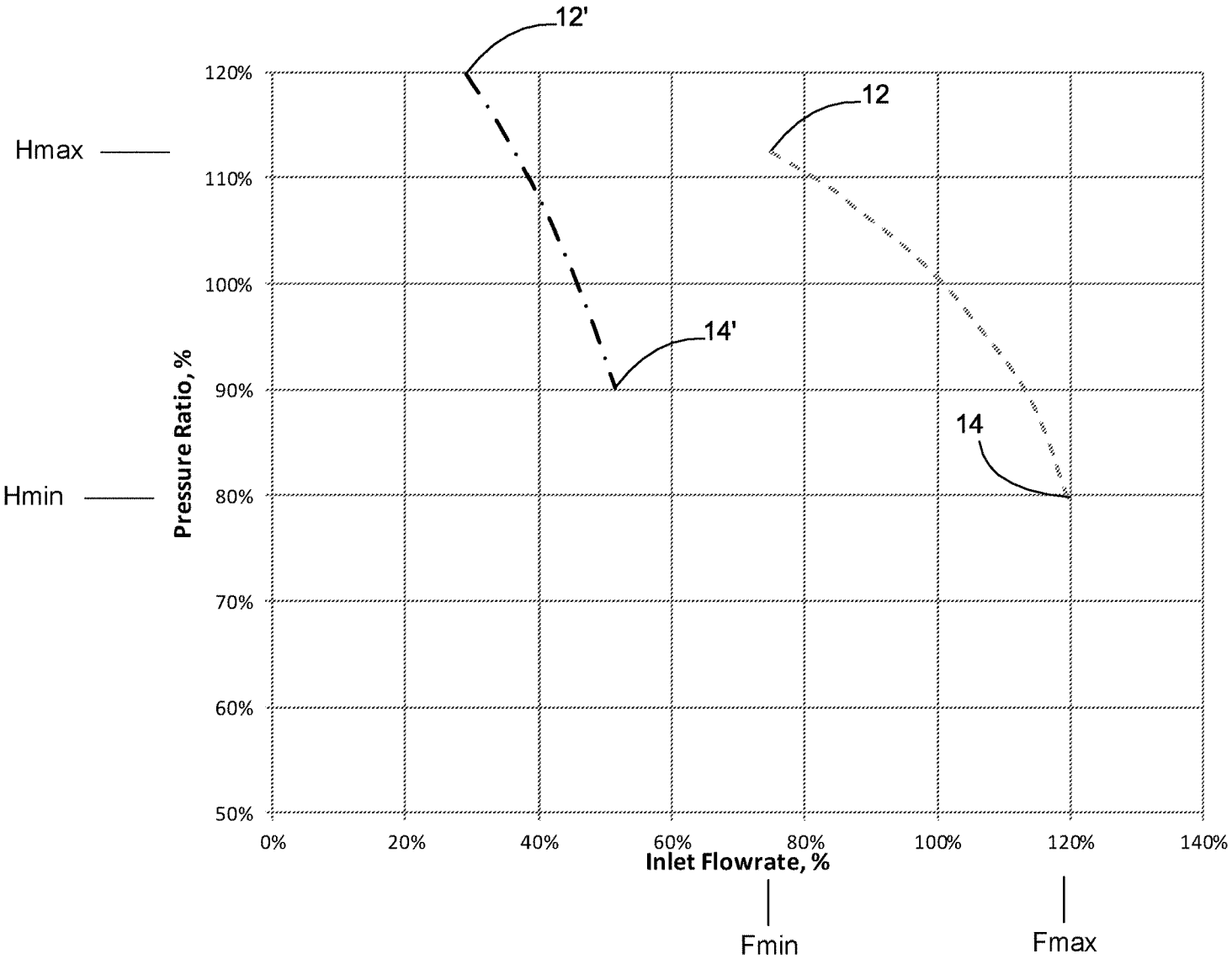
FIG. 10 is a graph of percent pressure ratio versus the percent inlet volumetric flow rate for a dynamic compressor.

The dashed line in FIG. 10 shows an exemplary relative head rise versus the relative inlet volumetric flow rate (both values with respect to a fixed reference point) curve for compressor stage 116B of FIG. 8. Dynamic compressors, the type most commonly used in the primary compression circuit, typically operate at a high inlet volumetric flow rate and have a high refrigerant flow capacity that is advantageous in base-load LNG service. As shown in FIG. 10, dynamic compressors, such as compressor stage 116B, typically have a gradual head-flowrate curve. A gradual curve is typically beneficial because it allows the compressor stage to be operated at a wide range of flow rates and pressures and makes them suitable for a variety of operating scenarios, such as turndown and varying ambient temperature.

The highest and lowest flowrates that a compressor stage is designed to handle are defined herein as Fmax and Fmin respectively. The highest and lowest head that a compressor is designed to handle are defined herein as Hmax and Hmin respectively. Hmax occurs at Fmin and is the surge operating point 12. Hmin occurs at Fmax and is the stonewall operating point 14. The ratio of Fmax to Fmin is defined as Fratio and the ratio of Hmax to Hmin is defined as Hratio. These operating points are identified in the graph of FIG. 10. The "head-flow ratio" is defined as Hratio divided by Fratio. A high head-flow ratio implies a steep head-flowrate curve and a low head-flow ratio implies a gradual head-flowrate curve.

Preferably, the compressor stages in the secondary compression circuit (whether they be a single compressor casing with multiple compressor stages or multiple compressor casings) possess a steeper head-flowrate curve than the primary compression circuit. An exemplary head-flow rate curve for compressor stage 187 of FIG. 8 is shown by the dash-dot line of FIG. 10, along with its surge point 12' and stonewall point 14'.

A typical head-flow ratio for the compressor stages in the primary compression circuit, including compressor stage 116B, is in the range of 50-95%. The head-flow ratio of each compressor stage in the secondary compression circuit is preferably lower than (more preferably, 70-95% of) the head-flow ratio of the compressor stage in the primary compression circuit that is immediately downstream from the point at which the slip stream is separated from its side stream. For example, in FIG. 8, the head flow ratio of compressor stage 187 is preferably less than (more preferably, 70-95% of) the head-flow ratio of compressor stage 116B.

The benefit of providing a steeper head-flow ratio for the secondary compression circuit is that it makes it easier to operate the primary and secondary compression circuits. The compressor stages of the primary and secondary compression circuits are designed for different flowrates, but the overall pressure ratio is usually the same to ensure same conditions at the outlet. The two compressions circuits are not identical and the second compression circuit typically has a of much smaller capacity than the main compression circuit. For example, in a C3MR plant operating close to surge, as the ambient temperature reduces, the approach to surge increases and a lower flow rate through the secondary compression circuit is required. Designing the compression stages of the secondary compression circuit with a steep head-flow curve allows the flow to be varied as needed. Therefore, this improvement addresses the challenge of debottlenecking the main compression circuit in the most efficient way possible. This embodiment leads to lower capital cost, plot space, and makes the design more flexible to operational changes and easier to control.

In all the embodiments discussed herein, the primary compression circuit and the secondary compression circuit may include compressors of any type. In alternate embodiments, the secondary compression circuit may be in parallel with any number of compressor stages of the primary compression circuit. In most applications, it will be preferable to have the secondary compression circuit arranged in parallel with the compressors or compressor stages of the primary compression circuit that operate at a higher pressure than any of the compressors or compressor stages that are not arranged in parallel with the secondary compression circuit.

Although the embodiments discussed herein refer to the propane pre-cooling compressor of a C3MR liquefaction cycle, the inventive concepts disclosed herein are applicable to any other refrigerant type including, but not limited to, two-phase refrigerants, gas-phase refrigerants, mixed refrigerants, pure component refrigerants (such as nitrogen) etc. In addition, they can be applied to a refrigerant being used for any service utilized in an LNG plant, including pre-cooling, liquefaction or sub-cooling. They may be applied to a compression system in a natural gas liquefaction plant utilizing any process cycle including SMR, DMR, nitrogen expander cycle, methane expander cycle, cascade and any other suitable liquefaction cycle. Additionally, they may be applied to both open-loop and closed-loop liquefaction cycles.

Another exemplary embodiment is applicable to scenarios wherein the LNG production is limited by the available driver power, such as at high production rates or during high ambient temperature due to reduced available power for gas turbine drivers. In such cases, an additional driver may be provided to drive secondary compressors. This would increase the available power in the compression systems and, at the same time, provide a convenient way to distribute the additional power to the compression systems and debottleneck the limiting stages. This is especially beneficial when performing a retrofit design to increase the capacity of an existing LNG plant.

The embodiments described herein are applicable to any compressor design including any number of compressors, compressor casings, compressor stages, presence of inter or after-cooling, presence of inlet guide vanes, etc. Additionally, the speed of the compressors in the primary or secondary compression circuits may be varied to optimize performance. The secondary compression circuit may comprise multiple compressors or compressor stages in series or in parallel. Further, the methods and systems described herein can be implemented as part of new plant design or as a retrofit to debottleneck existing LNG plants.

Example

The following is an example of the operation of an exemplary embodiment. The example process and data are based on simulations of a C3MR process in a plant that produces nominally 6 MTPA of LNG. This example specifically refers to the embodiment shown in FIG. 8. In order to simplify the description of this example, elements and reference numerals described with respect to the embodiment shown in FIG. 8 will be used.

In this example, the plant performance is limited by the second and third compressor stages 116B and 116C of the propane compressor 116, which is a centrifugal compressor operating at the maximum head possible. A double flow compressor 900 is added as shown in FIG. 8. Warm low pressure propane stream 114 enters the first compressor stage 116A at 1.2 bara (18.1 psia), −34.2 degrees C. (−29.6 degrees F.) and a refrigerant flow rate of 144,207 $m^3$/hr (5,092,606 $ft^3$/hr), and exits as the medium pressure propane stream 180 at a pressure of 2.1 bara (30.3 psia), −12.7 degrees C. (9.2 degrees F.). A low pressure side stream 113 at 2.1 bara (30.3 psia), −22.4 degrees C. (−8.4 degrees F.) and a flowrate of 118,220 m3/hr (4,174,916 ft3/hr) is split into a primary low pressure side stream 113A and a secondary low pressure side stream 113B. The secondary low pressure side stream 113B is at a flowrate of 40,000 m3/hr (1,412,587 ft3/hr). The primary low pressure side stream 113A is mixed with the medium pressure propane stream 180 to produce the medium pressure mixed stream 181, which is fed to the second compressor stage 116B to produce a high pressure propane stream 182 at a pressure of about 3.8 bara (54.5 psia), 6.3 degrees C. (43.4 degrees F.), and flowrate of 125,855 m3/hr (4,444,515 ft3/hr). A medium pressure side stream 112 at 3.8 bara (54.5 psia), −5.3 degrees C. (22.4 degrees F.), and flowrate of 103,857 m3/hr (3,667,683 ft3/hr) is split into a primary medium pressure side stream 112A and a secondary medium pressure side stream 112B. The secondary medium pressure side stream 112B has a flowrate of 28,284 m3/hr (998,857 ft3/hr). The high pressure propane stream 182 combines with the primary medium pressure side stream 112A to produce a high pressure mixed stream 183, which is sent to the third compressor stage 116C to produce a high-high pressure propane stream 184 at 6.6 bara (95.9 psia) and 26.3 degrees C. (79.4 degrees F.). The high-high pressure propane stream 184 then combines with high pressure side stream 111 at 6.6 bara (95.9 psia), 13 degrees C. (55.5 degrees F.), 33,459 m3/hr (1,181,598 ft3/hr) to produce high-high pressure mixed stream 185, which is sent to the fourth compressor stage 116D to produce the primary outlet stream 186A at 14.3 bara (207 psia), 59.2 degrees C. (138.5 degrees F.), and 73,605 m3/hr (2,599,353 ft3/hr).

The secondary low pressure side stream 113B and the secondary medium pressure side stream 112B are sent to a double flow compressor 900 to produce two compressed secondary intermediate streams 112C, 113C, which are mixed within the double flow compressor to produce an secondary outlet stream 186B at 14.3 bara (207 psia) and 15,383 m3/hr (543,242 ft3/hr). The secondary outlet stream 186B is mixed with the primary outlet stream 186A to produce a compressed propane stream 115 at 14.3 bara (207 psia), 60 degrees C. (140.1 degrees F.), and 88,954 m3/hr (3,141,374 ft3/hr). The compressed propane stream 115 is then cooled and condensed in condenser 117. The overall LNG production of the plant increased by about 10% as compared to the same system without the double flow compressor 900. Therefore, the configuration of this example is successful in debottlenecking the propane compressor and resulted in improved plant capacity and efficiency.

An invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A compression system operationally configured to compress a first stream of a first refrigerant having a first pressure to produce a first compressed refrigerant stream having a fully-compressed pressure, the compression system comprising:

at least one pre-cooling heat exchanger, each of the at least one pre-cooling heat exchangers being operationally configured to cool a hydrocarbon fluid by indirect heat exchange against the first refrigerant;

a primary compression circuit having a plurality of primary compressor stages and a plurality of a partially-compressed streams, each of the plurality of compressor stages having a suction side and a discharge side, each of the plurality of partially-compressed streams being in fluid flow communication with an outlet of one of the plurality of primary compressor stages and an inlet of another of the plurality of primary compressor stages, each of the plurality of partially-compressed streams having a pressure that is higher than the first pressure and lower than the fully-compressed pressure, the pressure of each of the plurality of partially-compressed streams being different than the pressure of every other of the plurality of partially-compressed streams, a final primary compressor stage of the plurality of primary compressor stages having an outlet that produces a first portion of the first compressed refrigerant steam;

a secondary compression circuit comprising a double flow compressor having a casing that defines an internal volume, a first inlet, a second inlet, and an outlet that produces a second portion of the first compressed refrigerant stream, the second portion of the first compressed refrigerant stream being in fluid flow communication with the first portion of the first compressed refrigerant stream, the casing further comprising a first compressor stage and a second compressor stage located in the internal volume, the first compressor stage having a first suction side, a first discharge side, at least one first impeller, and at least one first diffuser, the second compressor stage having a second suction side, a second discharge side, at least one second impeller, and at least one second diffuser, the first suction side being distal to the second suction side, and the first discharge side being proximal to the second discharge side;

a first side stream located downstream from and in fluid flow communication with a first pre-cooling heat exchanger of the at least one pre-cooling heat exchanger, the first side stream having a first side stream pressure and a first portion that is in fluid flow communication with a first partially-compressed first refrigerant stream of the plurality of partially-compressed streams to form a first mixed stream that is upstream from and in fluid flow communication with an inlet of a first primary compressor stage of the plurality of primary compressor stages, the first side stream having a second portion that is in fluid flow communication with the first inlet of the double-flow compressor; and a second side stream downstream from and in fluid flow communication with a second pre-cooling heat exchanger of the at least one pre-cooling heat exchanger, the second side stream having a second side stream pressure and a first portion that is in fluid flow communication with a second partially-compressed first refrigerant stream of the plurality of partially-compressed streams to form a second mixed stream that is upstream from and in fluid flow communication with an inlet of a second primary compressor stage of the plurality of primary compressor stages, the second side stream having a second portion that is in fluid flow communication with the second inlet of the double flow compressor;

wherein the first inlet is located on the first suction side of the first compressor stage, the second inlet is located on the second suction side of the second compressor stage, and the outlet is located proximal to the first discharge side and the second discharge side.

2. The compression system of claim 1, wherein the plurality of primary compressor stages are contained within a single primary compressor casing.

3. The compression system of claim 1, wherein the at least one first impeller consists of a first number of impellers, each having a first impeller geometry, the at least one second impeller consists of a second number of impellers, each having a second impeller geometry, the at least one first diffuser each having a first diffuser geometry, and the second at least one second diffuser having a second diffuser geometry; and wherein the first compressor stage differs from the second compressor stage by at least one selected from the group of: (a) the first number of impellers is different from the second number of impellers, (b) the first impeller geometry is different from the second impeller geometry, and (c) the first diffuser geometry is different from the second diffuser geometry.

4. The compression system of claim 1, wherein the compression system is further operationally configured to inter-cool the first refrigerant between at least two of the plurality of primary compressor stages of the primary compression circuit.

5. The compression system of claim 1, further comprising a main heat exchanger operationally configured to further cool and liquefy the hydrocarbon fluid by indirect heat exchange between the hydrocarbon fluid and a second refrigerant after the hydrocarbon fluid has been cooled by the at least one pre-cooling heat exchanger.

6. The compression system of claim 5, wherein the main heat exchanger is operationally configured to liquefy the hydrocarbon fluid and cool the second refrigerant as the hydrocarbon fluid and the second refrigerant flow through a coil wound tube side of the main heat exchanger by indirect heat exchange with the second refrigerant flowing through a shell side of the main heat exchanger.

7. The compression system of claim 1, wherein the second refrigerant is a mixed refrigerant and the first refrigerant is a propane.

8. The compression system of claim 1, further comprising a valve operationally configured to control a distribution of flow of the first refrigerant between primary compression circuit and the secondary compression circuit.

9. The compression system of claim 1, wherein the first primary compressor stage has a first primary head-flow ratio and the first compressor stage of the double flow compressor has a first secondary head-flow ratio that is less than the first primary head-flow ratio.

10. The compression system of claim 9, wherein the secondary head-flow ratio is 70-95% of the primary head-flow ratio.

11. A compressor comprising:

a casing that defines an internal volume, a first inlet, a second inlet, and an outlet, the casing further comprising a first compressor stage and a second compressor stage located in the internal volume, the first compressor stage having a first suction side, a first discharge side, at least one first impeller, and at least one first diffuser, the second compressor stage having a second suction side, a second discharge side, at least one second impeller, and at least one second diffuser, the first suction side being distal to the second suction side, the first discharge side being proximal to the second discharge side; and wherein the first inlet is located on the first suction side of the first compressor stage, the second inlet is located on the second suction side of the second compressor stage, and the outlet is located proximal to the first pressure side and the second pressure side;

wherein the at least one first impeller consists of a first number of impellers, each having a first impeller geometry, the at least one second impeller consists of a second number of impellers, each having a second impeller geometry, the at least one first diffuser each having a first diffuser geometry, and the second at least one second diffuser having a second diffuser geometry;

wherein the first compressor stage differs from the second compressor stage by at least one selected from the group of: (a) the first number of impellers is different from the second number of impellers, (b) the first impeller geometry is different from the second impeller geometry, and (c) the first diffuser geometry is different from the second diffuser geometry.

12. The compressor of claim 11, wherein the first number of impellers is greater than the second number of impellers.

13. The compressor of claim 11, further comprising a mixing chamber that is proximal to the first discharge side, the second discharge side, and the outlet.

14. The compressor of claim 11, wherein each of the at least one first impeller and each of the at least one second impeller are affixed to a first shaft.

15. A method comprising:

a. compressing a first low pressure stream of a refrigerant and at least one side stream of the refrigerant in a primary compression sequence comprising a plurality of compressor stages to form a first partially-compressed primary stream at a first intermediate pressure and a fully-compressed primary stream at a final pressure, the final pressure being greater than the first intermediate pressure;

b. combining a first side stream of the at least one side stream with the first partially-compressed refrigerant stream;

c. separating a first slip stream from one selected from the group of: the first low pressure stream and the first side stream, the first slip stream having a first slip stream pressure;

d. compressing the first slip stream in a first secondary compressor stage to form a first compressed secondary stream;

e. separating a second slip stream from one of the at least one side stream, the second slip stream having a second slip stream pressure that is greater than the first slip stream pressure;

f. compressing the second slip stream in a second secondary compressor stage to the final pressure to form a second compressed secondary stream;

g. combining the first compressed secondary stream and the second compressed secondary stream with the fully-compressed refrigerant stream; and h. cooling a hydrocarbon by indirect heat exchange with the refrigerant.

16. The method of claim 15, wherein steps (a), (b), and (d) comprise:

a. compressing a first stream of a refrigerant and at least one side stream of the refrigerant in a primary compression sequence comprising a plurality of compressor stages to form a first partially-compressed refrigerant stream at a first intermediate pressure, a second partially compressed refrigerant stream at a second intermediate pressure, and a fully-compressed refrigerant stream at a final pressure, the final pressure being greater than the second intermediate pressure and the second intermediate pressure being greater than the first intermediate pressure;

c. separating a first slip stream from a first side stream of the at least one side stream, the first slip stream having a first slip stream pressure that is equal to the first intermediate pressure; and d. separating a second slip stream from a second side stream of the at least one side stream, the second slip stream having a second slip stream pressure that is equal to the second intermediate pressure.

17. The method of claim 15, further comprising:

i. combining the first compressed secondary stream with the second slip stream before performing step (f).

18. The method of claim 15, further comprising, performing steps (f) and (g) within a double-flow compressor.

19. The method of claim 18, wherein steps (f) and (g) further comprise:

f. compressing the first slip stream in a first secondary compressor stage having a first discharge side to the final pressure to form a first compressed side stream; and g. compressing the second slip stream in a second secondary compressor stage, having a second discharge side that is proximal to the first discharge side, to the final pressure to form a second compressed side stream.

20. The method of claim 18, wherein steps (f) and (g) further comprise:

f. compressing the first slip stream a first secondary compressor stage, comprising at least one first impeller having a first impeller geometry, to the final pressure, to form a first compressed secondary stream; and g. compressing the second slip stream in a second secondary compressor stage, comprising at least one second impeller having a second impeller geometry that is different from the first impeller geometry, to the final pressure to form a second compressed secondary stream.

* * * * *